US009630415B2

(12) United States Patent
Qing et al.

(10) Patent No.: US 9,630,415 B2
(45) Date of Patent: Apr. 25, 2017

(54) INK CARTRIDGE REFILLING DEVICE AND INK CARTRIDGE REFILLING METHOD UTILIZING THE SAME FOR INK REFILLING

(75) Inventors: Lei Qing, Zhuhai (CN); Weijian Chen, Shanghai (CN)

(73) Assignee: ZHUHAI NINESTAR MANAGEMENT CO., LTD., Zhuhai (CN)

( * ) Notice: Subject to any disclaimer, the term of this patent is extended or adjusted under 35 U.S.C. 154(b) by 794 days.

(21) Appl. No.: 13/582,481

(22) PCT Filed: Nov. 2, 2010

(86) PCT No.: PCT/CN2010/078316

§ 371 (c)(1),
(2), (4) Date: Sep. 4, 2012

(87) PCT Pub. No.: WO2011/137637

PCT Pub. Date: Nov. 10, 2011

(65) Prior Publication Data

US 2013/0037164 A1 Feb. 14, 2013

(30) Foreign Application Priority Data

May 1, 2010 (CN) ..... 2010 1 0169525

(51) Int. Cl.
*B65B 31/04* (2006.01)
*B41J 2/175* (2006.01)

(52) U.S. Cl.
CPC ..... *B41J 2/17513* (2013.01); *B41J 2/17506* (2013.01); *B41J 2/17523* (2013.01); *B41J 2/17553* (2013.01)

(58) Field of Classification Search
CPC ..... B41J 2/17506
See application file for complete search history.

(56) References Cited

U.S. PATENT DOCUMENTS 7,470,008 B2 * 12/2008 Yan ..... 347/84

* cited by examiner

*Primary Examiner* — Jason K Niesz
(74) *Attorney, Agent, or Firm* — Anova Law Group, PLLC

(57) ABSTRACT

The invention relates to an ink cartridge refilling device, which comprises an ink container, an ink injection channel, an air suction channel, an air inlet channel and a leakage-proof component, wherein both the air suction channel and the air inlet channel are arranged inside the ink container; and the leakage-proof component is arranged on the air inlet channel. As both the air suction channel and the air inlet channel are arranged inside the ink container, the ink cartridge refilling device has the advantages of having compact overall structure, small space usage and simple operation, reducing the number of dies in the manufacturing process, fully reducing the manufacturing cost, and solving the technical problems of large space usage, trivial operation and high manufacturing cost in the traditional ink cartridge refilling device.

12 Claims, 5 Drawing Sheets

INK CARTRIDGE REFILLING DEVICE AND INK CARTRIDGE REFILLING METHOD UTILIZING THE SAME FOR INK REFILLING

FIELD OF THE INVENTION

The invention mainly relates to an ink cartridge refilling device and an ink cartridge refilling method utilizing the same for ink refilling.

BACKGROUND OF THE INVENTION

As for inkjet printers, ink is driven by print signals to be ejected to recording media such as paper through nozzles for printheads so as to complete the recording of characters or graphs. With the continuous development of the inkjet technology, the volume of the inkjet printers is smaller and smaller. Accordingly, the volume of ink cartridges taken as ink reservoirs is also limited, which results in the fact that users need to replace the ink cartridges continuously. However, most used ink cartridges are thrown away but cannot be degraded naturally as the ink cartridges contain plastics, membranes and the like, which would obviously cause resource waste and environmental pollution. Therefore, the preferred mode is for the ink cartridges not replaced but refilled with ink so that the ink cartridges can be subjected to secondary application. Consequently, in order to meet the requirement, there are a plurality of ink refilling devices for refilling ink cartridges on the market.

The U.S. Pat. No. 7,470,008 provides an ink cartridge refilling device for refilling ink into an ink cartridge by utilization of negative pressure. The ink cartridge refilling device comprises an ink bottle for receiving ink for refilling, a pedestal for placing an ink cartridge to be refilled, an aspirator for reducing the pressure in the ink cartridge, L-shaped connectors which are connected with the ink bottle and the ink cartridge respectively, and a hose which is connected with the two L-shaped connectors. The application process of the ink cartridge refilling device is as follows: the ink cartridge is fixed on the pedestal; the two L-shaped connectors are respectively connected with an ink bottle opening and an ink injection opening of the ink cartridge; and the aspirator is connected with an ink outlet of the ink cartridge to suck air in the ink cartridge, so that certain negative pressure can be generated in the ink cartridge. Due to the pressure balance principle, ink in the ink bottle would flow into the ink cartridge, and it indicates that the ink cartridge is completely refilled with the ink when the ink is found in the aspirator.

However, in the above method, the ink bottle, the pedestal, the ink cartridge and the like are separately arranged. When the ink cartridge refilling device is used, users need to use the hose to connect two of the components. Therefore, the ink cartridge refilling device has the disadvantages of trivial operation, poor sealing property and large space usage. In addition, various components must be manufactured separately in the aspect of production, that is to say, a plurality of sets of dies must be prepared, which would result in high production cost.

SUMMARY OF THE INVENTION

The object of the invention is to provide an ink cartridge refilling device to solve the technical problems of large space usage, trivial operation and high manufacturing cost of the traditional ink cartridge refilling device.

In order to achieve the object, the technical proposal adopted by the invention is as follows:

The invention relates to an ink cartridge refilling device, which comprises:

an ink container for storing ink used to be refilled into an ink cartridge to be refilled;

an ink injection channel in close connection with an ink injection opening of the ink cartridge to be refilled;

an air suction channel, in which one end of the air suction channel is a sucking end which is engaged with an aspirator to suck air in the ink cartridge to be refilled, and the other end of the air suction channel is an sucking opening which is directly connected with an ink outlet of the ink cartridge to be refilled; and an air inlet channel for introducing air into the ink container from the outside, wherein both the air suction channel and the air inlet channel are formed on the ink container.

A leakage-proof component is arranged on the air inlet channel.

The air inlet channel and the air suction channel are coaxially arranged.

The air inlet channel and the air suction channel are respectively arranged at different positions of the ink container.

The leakage-proof component is a valve component.

The valve component comprises a seal ring, an elastic member and a valve seat, wherein the seal ring is tightly engaged with the valve seat; and one end of the elastic member abuts against the seal ring while the other end of the elastic member abuts against the air inlet channel.

The valve component also comprises a bushing of which the hardness is more than that of the seal ring, wherein the seal ring is tightly engaged with the valve seat; the bushing is tightly engaged with the seal ring; and one end of the elastic member abuts against the seal ring while the other end of the elastic member abuts against the air inlet channel.

The valve component is a self-closing valve.

The leakage-proof component is a waterproof permeable membrane.

The leakage-proof component is a sealing plug.

The air suction channel adopts a linear type and passes across the ink container.

The ink cartridge refilling device is also provided with a positioning component for fixing the ink cartridge on the ink cartridge refilling device.

The invention relates to an ink cartridge refilling method utilizing an ink cartridge refilling device according to claim 1 for ink refilling, which comprises the following steps of:

A. Fixing an ink cartridge to be refilled on the ink cartridge refilling device so that an ink injection opening of the ink cartridge to be refilled is in close connection with an ink injection channel and an ink outlet of the ink cartridge to be refilled is in close connection with a sucking opening;

B. Inverting the ink cartridge refilling device so that the ink cartridge to be refilled is arranged under the ink cartridge refilling device; and C. Connecting an aspirator and a sucking end of an air suction channel to suck air in the ink cartridge to be refilled.

The ink cartridge refilling method further comprises step D after the step C is over, namely the aspirator is taken off when ink is found in the aspirator, and the ink cartridge is taken off In the step D, before the ink cartridge is taken off, the ink cartridge and the ink cartridge refilling device are rotated so that the ink cartridge is arranged above the ink cartridge refilling device.

By adoption of the technical proposal, as both the air suction channel and the air inlet channel are arranged inside the ink container, the ink cartridge refilling device has the advantages of having compact overall structure, small space usage and simple operation, reducing the number of dies in the manufacturing process, fully reducing the manufacturing cost, and solving the technical problems of large space usage, trivial operation and high manufacturing cost in the traditional ink cartridge refilling device. Moreover, due to the arrangement of the leakage-proof component on the air inlet channel, ink leakage can be effectively prevented no matter during the use or during the transportation of the ink cartridge refilling device.

DETAILED DESCRIPTION OF THE PREFERRED EMBODIMENTS

Further description is given to the invention with the attached drawings and embodiments.

Embodiment 1

Figure 1:
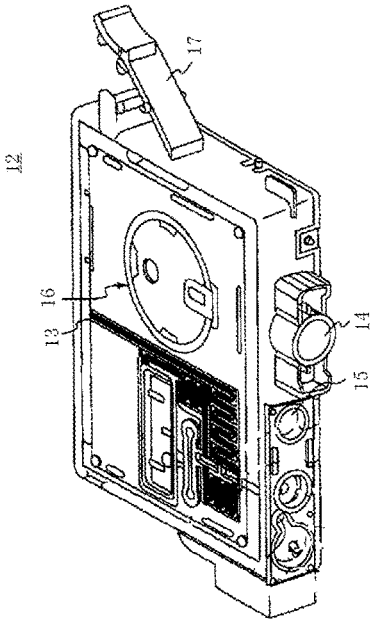
FIG. 1 is a schematic diagram of an ink cartridge to be refilled of embodiments 1, 2 and 3.

FIG. 1 is a structure diagram of an ink cartridge 12 to be refilled of the embodiment. The ink cartridge 12 is made of plastics; an ink storage cavity 14 for receiving ink to be supplied to a printer is reserved inside the ink cartridge 14; an ink outlet 15, an ink injection opening and an elastic handle 17 are also arranged on the ink cartridge 12; the ink outlet 15 can be engaged with an ink supply needle of the printer to convey ink to a printhead of the printer; the ink injection opening is used for refilling the ink into the ink storage cavity 14; the elastic handle 17 is engaged with a corresponding member on the printer to fix the ink cartridge 12 on the printer; and a one-way membrane valve 16 is arranged on an ink flow channel between the ink storage cavity 14 and the ink outlet 15. The membrane valve 16 is generally in the closing state but can be selectively opened or closed according to the pressure difference between the ink storage cavity 14 and the ink outlet 15. Obviously, the negative pressure in the ink cartridge 12 can be effectively adjusted due to adoption of the one-way membrane valve 6, so that the ink can be stably supplied to the ink outlet 15.

Figure 2:
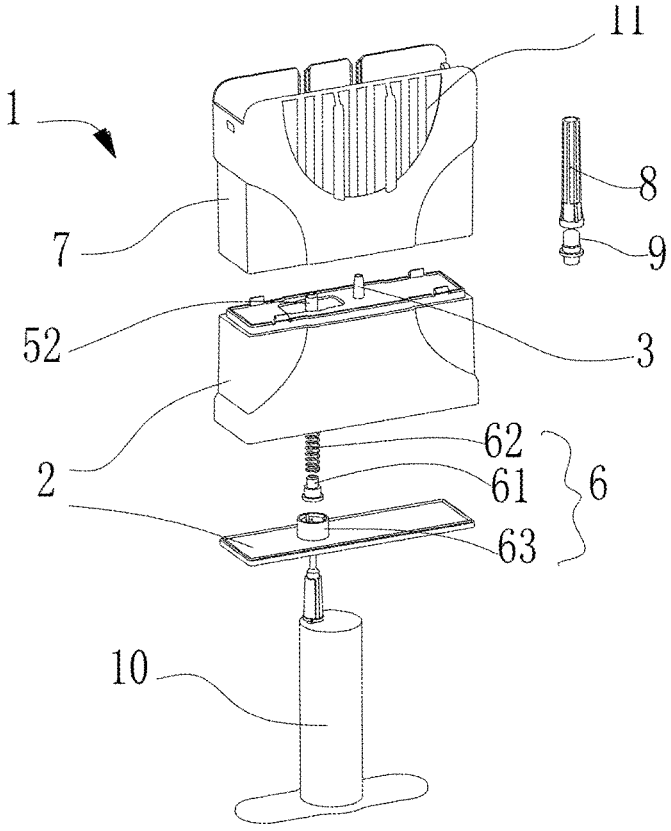
FIG. 2 is an exploded view of an ink cartridge refilling device in the embodiment 1.

FIG. 2 is an exploded view of an ink cartridge refilling device 1 in the embodiment. As illustrated in FIG. 2, the ink cartridge refilling device 1 comprises an ink container 2, an ink injection channel 3, an air inlet channel 4 and an air suction channel 5, wherein the ink to be refilled into the ink cartridge 12 is stored into the ink container 2; the ink injection channel 3 can be connected with the ink injection opening of the ink cartridge 12 to refill the ink into the ink cartridge 12; the air inlet channel 4 is arranged inside the ink container 2 and can be used for introducing exterior atmosphere into the ink container 2 when the ink cartridge refilling device is in use, so as to adjust the internal pressure of the ink container 2; the air suction channel 5 comprises a sucking opening 52 and a sucking end 51; the sucking opening 52 is connected with the ink outlet 15 of the ink cartridge 12; and the sucking end 51 can be engaged with an aspirator 10 to suck air in the ink cartridge 12 to be refilled, so as to form negative pressure in the ink cartridge 12. In the embodiment, the air suction channel 5 adopts a linear type, passes across the ink container 2, and is connected with the ink outlet 15, namely the air suction channel 5 is arranged inside the ink container 2 but is not communicated with the ink container 2 and is only communicated with the ink cartridge 12. Therefore, when the air suction channel 5 is used for suction at the time, only the air in the ink cartridge 12 is sucked while the air in the ink container 2 is not sucked, thus guaranteeing constant air capacity of the air sucked during the repeated filling and guaranteeing constant volume of ink refilled each time. Moreover, preferably, the air inlet channel and the air suction channel are coaxially arranged in the embodiment for the realization of more compact structure of the ink cartridge refilling device.

As illustrated in FIG. 2, the ink cartridge refilling device is also provided with a positioning component 7 for fixing the ink cartridge 12, the aspirator 10 engaged with the sucking end 51 of the air suction channel 5 to suck the air, and a holding component 11 providing convenience for users to hold the ink cartridge refilling device. The holding component 11 is formed by a plurality of grooves which are parallel to the outerwall of the ink cartridge refilling device, and can be used as a connecting component between adjacent ink cartridge refilling devices, only with the need of arranging bulges of which the shape is tallied with that of the groove on the outside of another ink cartridge refilling device (not shown in the figure). Therefore, the users can conveniently connect a plurality of ink cartridge refilling devices carrying ink of different colors together, thus the ink cartridge refilling devices are convenient to store.

Figure 4:
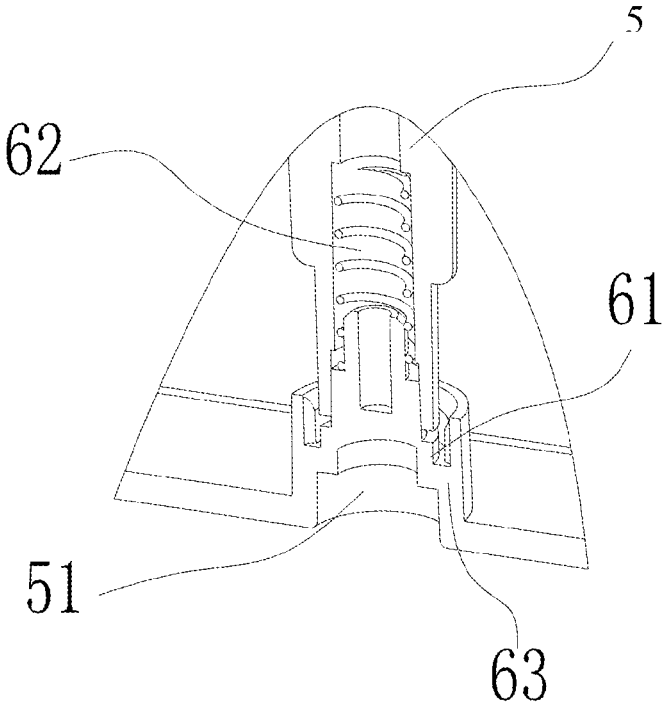
FIG. 4 is a partial enlarged view of a valve component in the embodiment 1 in the closing state, namely an enlarged view of A in FIG. 3.
Figure 6:
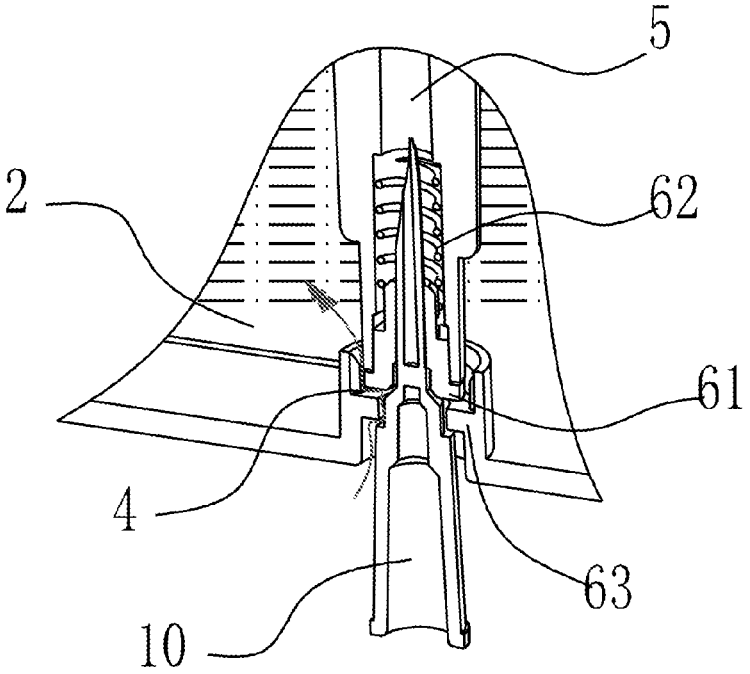
FIG. 6 is a partial enlarged view illustrating a valve component of the ink cartridge refilling device in the embodiment 1 in use, namely an enlarged view of B in FIG. 5.

A leakage-proof component is also arranged on the air inlet channel 4 for preventing the ink leakage on the air inlet channel 4 when the ink cartridge refilling device is transported or used. The leakage-proof component can be a waterproof permeable membrane which allows the air to enter but prevent the ink from flowing out, and can also be a rubber stopper which can be disassembled or assembled by the users. Preferably, the leakage-proof component in the embodiment is a valve component 6 which can be selectively opened or closed. Due to the coaxial arrangement of the air inlet channel 4 and the air suction channel 5, the valve component 6 is arranged at the sucking end 51 of the air suction channel 5. As illustrated in FIG. 4, the valve component 6 in the embodiment comprises a seal ring 61, a spring 62 and a valve seat 63. Obviously, the valve component 6 can selectively open or close the air inlet channel 4. When the ink cartridge refilling device 1 is not used, the valve component 6 is in the closing state. One end of the spring is connected with the seal ring 61 while the other end of the spring is connected with the air inlet channel 4, so that the seal ring 61 can be tightly engaged with the valve seat 63 under the action of an elastic force of the spring 62 to prevent the air from entering into the ink container 2. As illustrated in FIG. 6, when the ink cartridge refilling device 1 is used to refill ink into the ink cartridge 12, the aspirator 10 and the sucking end 51 are used together to generate a downward acting force to drive the spring 62 to be deformed and move downwards as the downward acting force is more than the elastic force of the spring 62, and the seal ring 61 is driven to move downwards and be departed from the valve seat 63, namely the valve component 6 moves downwards to open the air inlet channel 4 so as to drive the exterior air to be refilled into the ink container 2 along the illustrated trajectory. When the aspirator 10 is pulled out, the seal ring 61 is tightly engaged with the valve seat 63 again under the action of the spring 62, and the air inlet channel 4 is closed again.

In addition, as illustrated in FIG. 2, when the ink cartridge refilling device 1 is not used, one end of the ink injection channel 3, which is connected with the ink injection opening, is sealed by a sealing component so as to prevent the ink leakage during the transportation of the ink cartridge refilling device 1. The sealing component consists of a sleeve 8 and a rubber stopper 9, wherein the hardness of the sleeve 8 is more than that of the rubber stopper 9. The reason is as follows: as the space on the upper part of the ink cartridge refilling device for receiving the ink cartridge 12 is relatively narrow for the realization of small size of the ink cartridge refilling device, a user needs to plunge a hand into the narrow space to take out the rubber stopper 9 when the ink cartridge refilling device is used if only the rubber stopper 9 is used for sealing, which is very troublesome. Therefore, the sleeve 8 is arranged and can be integrated into a whole with the rubber stopper 9. Moreover, as the length of the sleeve 8 is long and slightly less than that of the ink cartridge 12, the user only needs to pull out the sleeve 8 when the ink cartridge refilling device is used, and the rubber stopper 9 can be pulled out as well and then the ink injection channel 3 can be opened, thus the operation is simple and convenient.

The steps of the method utilizing the ink cartridge refilling device 1 to refill ink into the ink cartridge 12 are explained as follows:

(1) Placing the ink cartridge refilling device 1 on a plane, and pulling out sealing components 8 and 9 of the ink injection channel 3.

Figure 3:
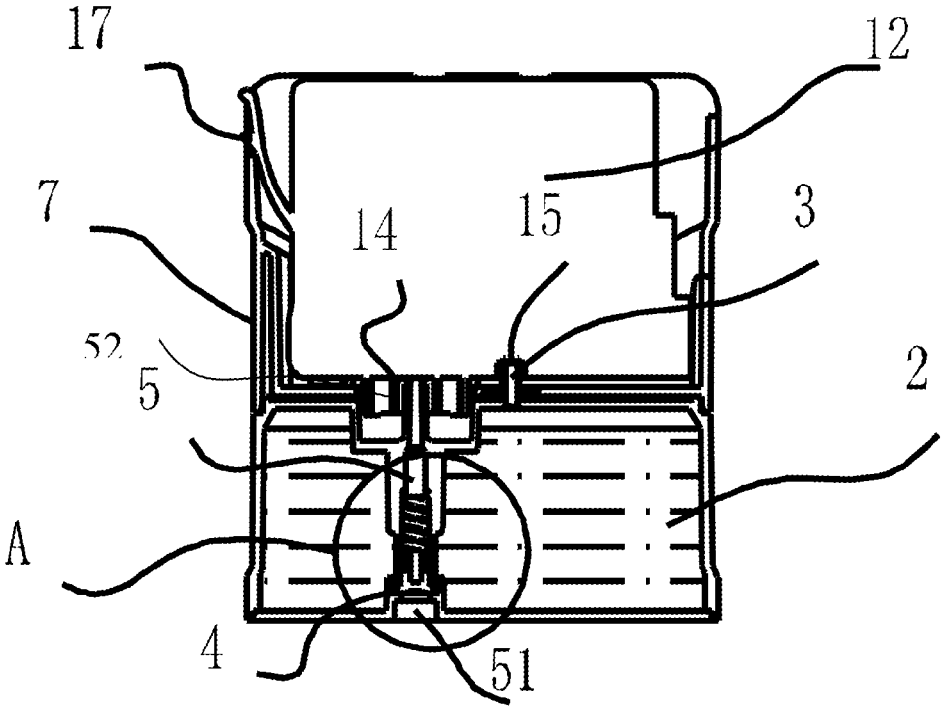
FIG. 3 is a state diagram illustrating the state when the ink cartridge refilling device in the embodiment 1 does not begin refilling.

(2) Placing the ink cartridge 12 on the ink cartridge refilling device 1 as illustrated in FIG. 3, wherein the elastic handle 17 of the ink cartridge 12 is engaged with the positioning component 7 of the ink cartridge refilling device to fix the ink cartridge 12; and the ink outlet 15 and the ink injection opening of the ink cartridge 12 are respectively connected with the sucking opening and the ink injection channel 3 of the ink cartridge refilling device.

(3) Inverting the ink cartridge 12 and the ink cartridge refilling device 1 which are fixed as a whole, so that the ink container 2 is arranged on the ink cartridge 12.

Figure 5:
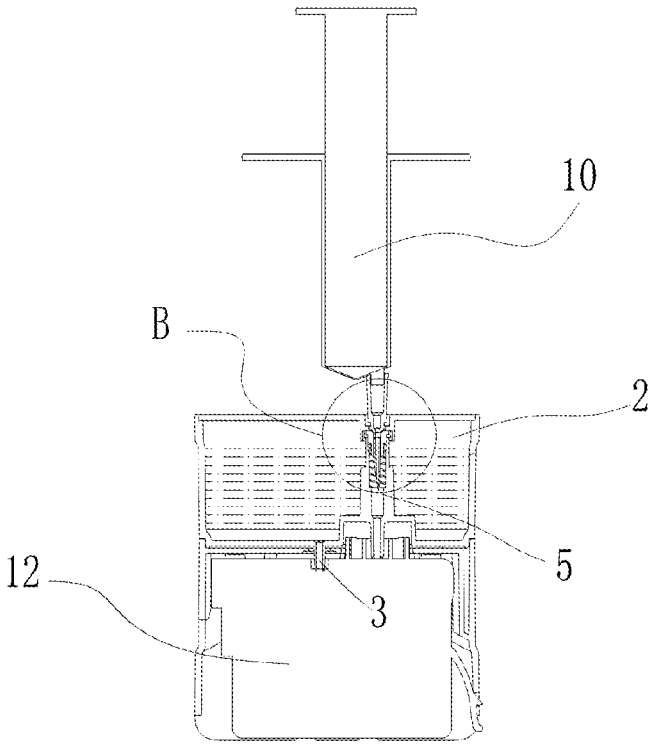
FIG. 5 is a state diagram illustrating the ink cartridge refilling device in the embodiment 1 in the refilling process.

(4) Connecting the prepared aspirator 10 and the sucking end 51 of the air suction channel 5 to suck the air in the ink cartridge 12. Obviously, a one-way membrane valve of the ink cartridge 12 is opened and the air in the ink storage cavity 14 is sucked as well, namely the ink cartridge 12 is in the vacuum state. Due to the pressure balance principle, as illustrated in FIG. 5, the ink in the ink container 2 is refilled into the ink cartridge 12. Moreover, as the valve component 6 arranged inside the air suction channel 5 is opened and the exterior atmosphere can enter into the ink container 2 through the air inlet channel 4, constant pressure in the ink container 2 is guaranteed.

(5) When the ink is found in the aspirator 10, it indicates that the ink cartridge 12 is fully refilled and can be used for printing. Herein, taking off the aspirator 10 first, wherein the air inlet channel 4 can be closed by the valve component 6 under the action of the elastic force of the spring 62, so that the ink container 2 can be sealed.

Figure 7:
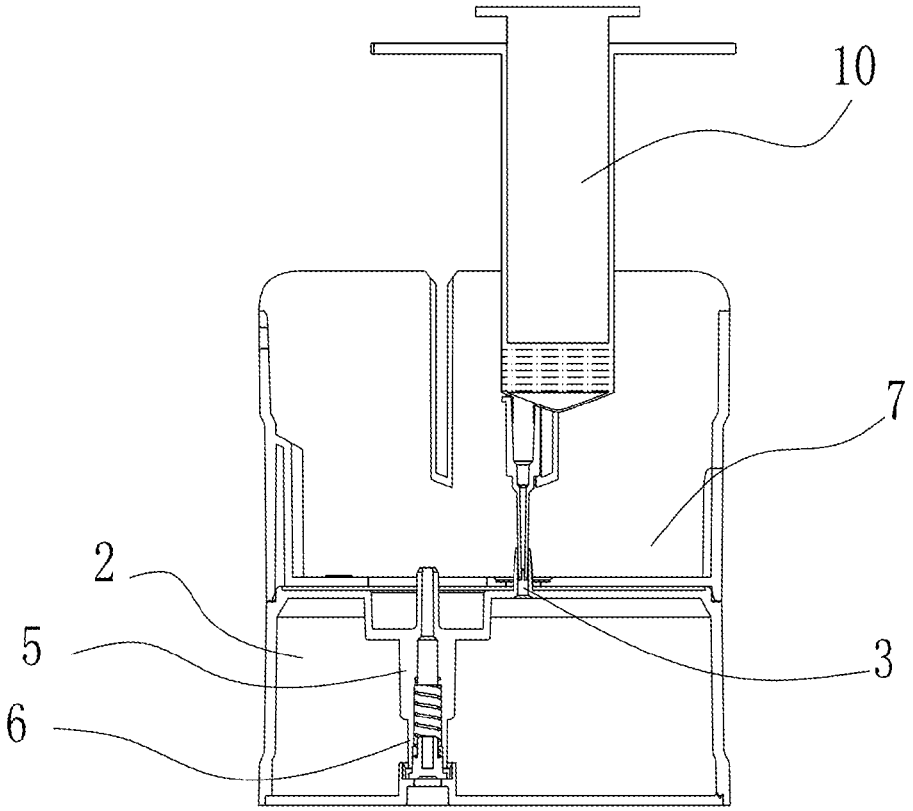
FIG. 7 is a state diagram illustrating the state when the ink cartridge refilling device in the embodiment 1 finishes refilling.

(6) Inverting the ink cartridge 12 and the ink cartridge refilling device 1 again as illustrated in FIG. 7, so that the ink cartridge 12 is arranged on the ink container 2; taking off the ink cartridge 12; and connecting the aspirator 10 and the ink injection channel 3 to inject residual ink in the aspirator 1 back into the ink container 2.

(7) Finally, taking off the aspirator 10, and using the original sealing components 8 and 9 to seal the ink injection channel 3.

In summary, the invention provides an ink cartridge refilling device, of which both an air inlet channel and an air suction channel are arranged inside an ink container, and a corresponding refilling method, so as to enable the ink cartridge refilling device to have small space usage, simple operation and low manufacturing cost and indirectly reduce the use cost of users.

Embodiment 2

Figure 8:
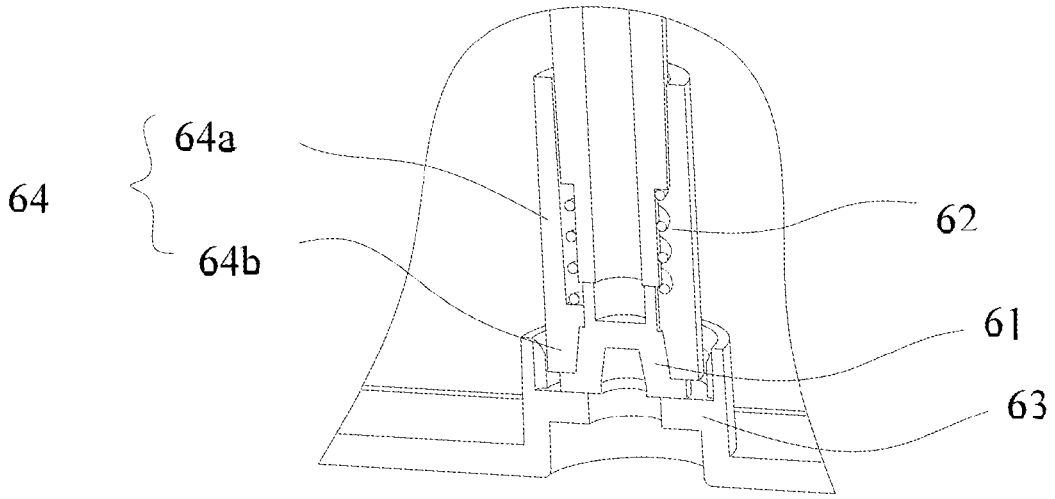
FIG. 8 is a structure diagram of an ink cartridge refilling device in the embodiment 2.

As illustrated in FIG. 8, the embodiments 1 and 2 are different in the structure of the valve component. In the embodiment, the valve component 6 consists of a bushing 64, a seal ring 61, a spring 62 and a valve seat 63, wherein the seal ring 61 is tightly engaged with the valve seat 63; the bushing 64 is engaged with the seal ring 61; the hardness of the bushing 64 is more than that of the seal ring 61; and the bushing 64 can slide along the air suction channel 5, as the bushing 64 consists of a engagement section 64*a* of which the diameter is equal to that of the seal ring 61 and a sliding section 64*b* of which the diameter is more than that of the air suction channel 5. Therefore, when the ink cartridge refilling device 1 is used, the seal ring 61 would be departed from the valve seat 63 under the action of an acting force generated by the fitting of the aspirator 10 and the sucking end 51. Herein, due to the fitting of the bushing 64 and the seal ring 61, the bushing 64 also moves downwards along the air suction channel 5. Obviously, the valve component 6 is opened at the moment, and the air can enter into the ink container so as to adjust the pressure in the ink container 2.

By adoption of the valve component 6, although only one part is added compared with the valve component 6 of the embodiment 1, the ink cartridge refilling device 1 can be opened without overlarge acting force when the aspirator 10 is inserted; thereby the control precision is improved.

The other structures and particular operation modes of the ink cartridge refilling device are similar to those of the embodiment 1 and not explained in detail herein.

Embodiment 3

Figure 9:
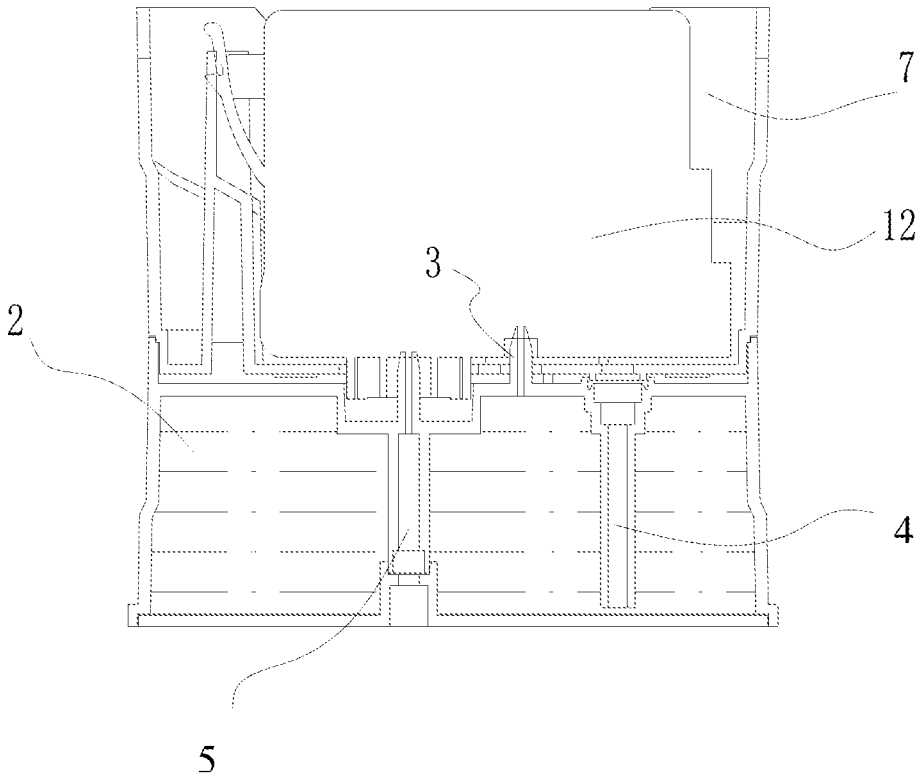
FIG. 9 is a structure diagram of an ink cartridge refilling device in the embodiment 3.

As illustrated in FIG. 9, the embodiments 3 and 1 are different in that the air inlet channel 4 and the air suction channel 5 are separately arranged at different positions of the ink container 2 and a one-way valve is arranged on the air inlet channel 4 to control the air admission (not shown in the figure). The one-way valve can be a self-closing valve which is engaged with an air inlet and opened according to the internal and the external pressure difference and can be a membrane valve and the like. All the valves belong to the mature technology in the field, can select a proper structure, and are not explained in detail herein. The air suction channel 5 is sealed by a seal ring 61 which is made of silica gel and has large elasticity. When the ink cartridge refilling device is used, the aspirator 10 passes through the seal ring 61 to suck air in the ink cartridge 12. When the aspirator 10 is taken out, a section on the seal ring 61, for the aspirator 10 to pass through, can be self-sealed under the action of the elasticity so as to prevent the ink leakage in the ink container 2.

Obviously, compared with the embodiment 1, the embodiment 3 has the advantages of increased number of components and parts and low technological requirements.

The other structures and particular operation modes of the ink cartridge refilling device 1 are similar to those of the embodiment 1 and not explained in detail herein.

What is claimed is:

1. An ink cartridge refilling device, comprising:

an ink container for storing ink used to be refilled into an ink cartridge to be refilled;

an ink injection channel in close connection with an ink injection opening of said ink cartridge to be refilled;

an air suction channel, in which one end of said air suction channel is a sucking end which is engaged with an aspirator to suck air in said ink cartridge to be refilled, and the other end of said air suction channel is an sucking opening which is directly connected with an ink outlet of said ink cartridge to be refilled; and an air inlet channel for introducing air into said ink container from the outside, wherein both said air suction channel and said air inlet channel are formed on said ink container.

2. The ink cartridge refilling device according to claim 1, wherein a leakage-proof component is arranged on said air inlet channel.

3. The ink cartridge refilling device according to claim 1, wherein said air inlet channel and said air suction channel are coaxially arranged.

4. The ink cartridge refilling device according to claim 1, wherein said air inlet channel and said air suction channel are respectively arranged at different positions of said ink container.

5. The ink cartridge refilling device according to claim 2, wherein said leakage-proof component is a valve component.

6. The ink cartridge refilling device according to claim 5, wherein said valve component comprises a seal ring, an elastic member and a valve seat; said seal ring is tightly engaged with said valve seat; and one end of said elastic member abuts against said seal ring while the other end of said elastic member abuts against said air inlet channel.

7. The ink cartridge refilling device according to claim 6, wherein said valve component also comprises a bushing of which the hardness is more than that of said seal ring; said seal ring is tightly engaged with said valve seat; said bushing is tightly engaged with said seal ring; and one end of said elastic member abuts against said seal ring while the other end of said elastic member abuts against said air inlet channel.

8. The ink cartridge refilling device according to claim 5, wherein said valve component is a self-closing valve.

9. The ink cartridge refilling device according to claim 2, wherein said leakage-proof component is a waterproof permeable membrane.

10. The ink cartridge refilling device according to claim 2, wherein said leakage-proof component is a sealing plug.

11. The ink cartridge refilling device according to claim 1, wherein said air suction channel adopts a linear type and passes across said ink container.

12. The ink cartridge refilling device according to claim 1, wherein said ink cartridge refilling device is also provided with a positioning component for fixing said ink cartridge on said ink cartridge refilling device.

* * * * *